United States Patent [19]

Watanabe et al.

[11] 4,278,147

[45] Jul. 14, 1981

[54] MUFFLER FOR ENGINE, PARTICULARLY MOTORCYCLE ENGINE

[75] Inventors: Junichi Watanabe, Kobe; Takahiko Aoyama, Akashi; Norio Gotoh, Gifu, all of Japan

[73] Assignee: Kawasaki Jukogyo Kabushiki Kaisha, Kobe, Japan

[21] Appl. No.: 118,880

[22] Filed: Feb. 6, 1980

[30] Foreign Application Priority Data

Feb. 8, 1980 [JP] Japan ..... 55-15720[U]

[51] Int. Cl.[3] ..... F01N 1/24

[52] U.S. Cl. ..... 181/256; 181/272

[58] Field of Search ..... 181/231, 240, 243, 256, 181/252, 264, 272, 269; 55/276

[56] References Cited

U.S. PATENT DOCUMENTS

| | | | |
|---|---|---|---|
| 3,380,553 | 4/1968 | Gibel | 181/269 X |
| 4,113,051 | 9/1978 | Moller | 181/256 |
| 4,149,611 | 4/1979 | Taguchi | 181/252 |
| 4,203,503 | 5/1980 | Franco et al. | 181/272 |

*Primary Examiner*—L. T. Hix
*Assistant Examiner*—Benjamin R. Fuller
*Attorney, Agent, or Firm*—Jordan and Hamburg

[57] ABSTRACT

A muffler for a motorcycle engine including a hollow, frustoconical muffler body, a hollow sound-absorbing member snugly fitted in the muffler body and maintained in intimate contact with the inner surface thereof, and a keep member for securing the sound-absorbing member in place. The sound-absorbing member is inserted in the muffler body and the keep member is inserted therein. The keep member is pressed into the hollow sound-absorbing member by a muffler core as the latter is inserted therein, to force the sound-absorbing member against the inner surface of the muffler body in intimate contact therewith. The muffler core includes a baffle tube extending axially of the muffler body, and a plurality of discal baffle plates secured to the baffle tube to define a plurality of chambers in the muffler body when fitted therein.

14 Claims, 3 Drawing Figures

MUFFLER FOR ENGINE, PARTICULARLY MOTORCYCLE ENGINE

BACKGROUND OF THE INVENTION

This invention relates to a muffler for an engine, particularly a motorcycle engine, for reducing the noises produced by exhaust emissions of the engine.

In one type of muffler for an engine, a sound-absorbing means formed as of glass fibers in mounted in a muffler body connected to an exhaust pipe and secured in place by a keep means in the form of a perforated plate, for example, so as to reduce the noises produced by the muffler body when it vibrates.

The aforesaid type of muffler of the prior art is shown in FIG. 1, wherein a muffler body 1 is composed of two halves 2 and 3 welded together and having sound-absorbing members 4 and 5 attached to the inner surfaces thereof respectively. The sound-absorbing members 4 and 5 are secured to the muffler body 1 by keep members 6 and 7 respectively. When the muffler of the aforesaid construction is fabricated, the sound-absorbing members 4 and 5 are attached to the respective halves 2 and 3 and secured in place by the respective keep members 6 and 7. The keep members 6 and 7 are joined as by spot welding to the halves 2 and 3 at their edges 6*a* and 7*a* respectively. Then, the two halves 2 and 3 are joined as by welding at the seams.

In the muffler fabricated as aforesaid, the muffler body produced by welding the two halves together into a unitary structure has on its outer surface dents or marks produced at the time the welding is performed, which spoil the good external appearance of the muffler, particularly when it is used with a motorcycle, if they are left unattended. For this reason, the muffler is subjected to after-treatment, such as buffing, to remove the dents or marks from the muffler body. The step of buffing the muffler body, as well as the steps of securing a plurality of sound-absorbing members to the respective halves of the muffler by means of the respective keep members, makes the muffler fabricating operation time consuming and requiring a lot of labor. The problem with regard to the dents or marks formed when welding is performed may be obviated by producing the muffler body in cylindrical form by form rolling from the beginning. However, difficulties will be encountered in attaching the sound-absorbing members to the cylindrical muffler body, so that it would become impossible to use the sound-absorbing members for reducing the noises produced by the muffler body when it vibrates.

SUMMARY OF THE INVENTION

An object of this invention is to provide a muffler for an engine that can be produced with less difficulties than mufflers of the prior art.

Another object is to provide a muffler for an engine which requires no welding for securing a sound-absorbing member to the muffler body by a keep member.

Still another object is to provide a muffler for an engine which allows a sound-absorbing member to be readily attached to its muffler body regardless of whether the muffler body is composed of two halves joined to each other or formed as a unitary structure from the beginning.

A further object is to provide a muffler for an engine which permits plating of the muffler body for rendering the muffler for a motorcycle engine anti-corrosive to be effected before various elements of the muffler are attached to the muffler body or when such muffler body has been connected to the exhaust pipe, not after all the elements of the muffler have been attached to the muffler body.

According to the present invention, there is provided a muffler for an engine, particularly a motorcycle engine comprising a hollow muffler body tapering at least in one portion thereof, a tapering hollow sound-absorbing member inserted in said muffler body through a major diameter end thereof and fitted in said tapering portion thereof, a keep body inserted in said muffler body through said major diameter end thereof and fitted in said sound-absorbing member to secure the sound-absorbing member in place, said keep member being of a construction allowing exhaust gases to permeate therethrough to the sound-absorbing member, and a muffler core inserted in said muffler body through said major diameter end thereof after said sound-absorbing member and said keep member have been inserted therein, said muffler core comprising at least two baffle plates conforming to the inner surface of said muffler body and constructed such that said sound-absorbing member can be forced against the inner surface of the muffler body if the muffler core is pressed axially of the muffler body when the former is inserted in the latter, said at least two baffle plates defining at least two chambers within said muffler body maintained in fluid communication with one another.

Additional and other objects, features and advantages of the present invention will become apparent from the description of the embodiment set forth hereinafter when considered in conjunction with the accompanying drawings.

DESCRIPTION OF THE PREFERRED EMBODIMENT

Figure 1:
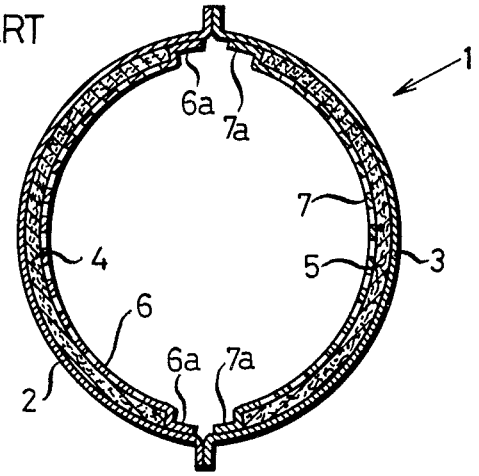
FIG.1 PRIOR ART
FIG. 1 is a transverse sectional view of a muffler of the prior art, showing its internal structure.
Figure 3:
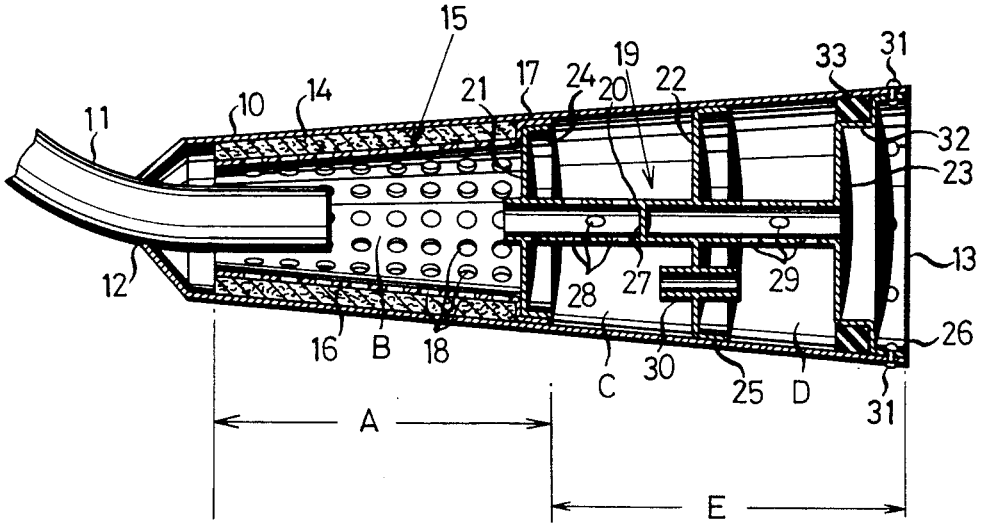
FIG. 3 is a vertical sectional view of the muffler after all the elements have been attached to the muffler body.
Figure 2:
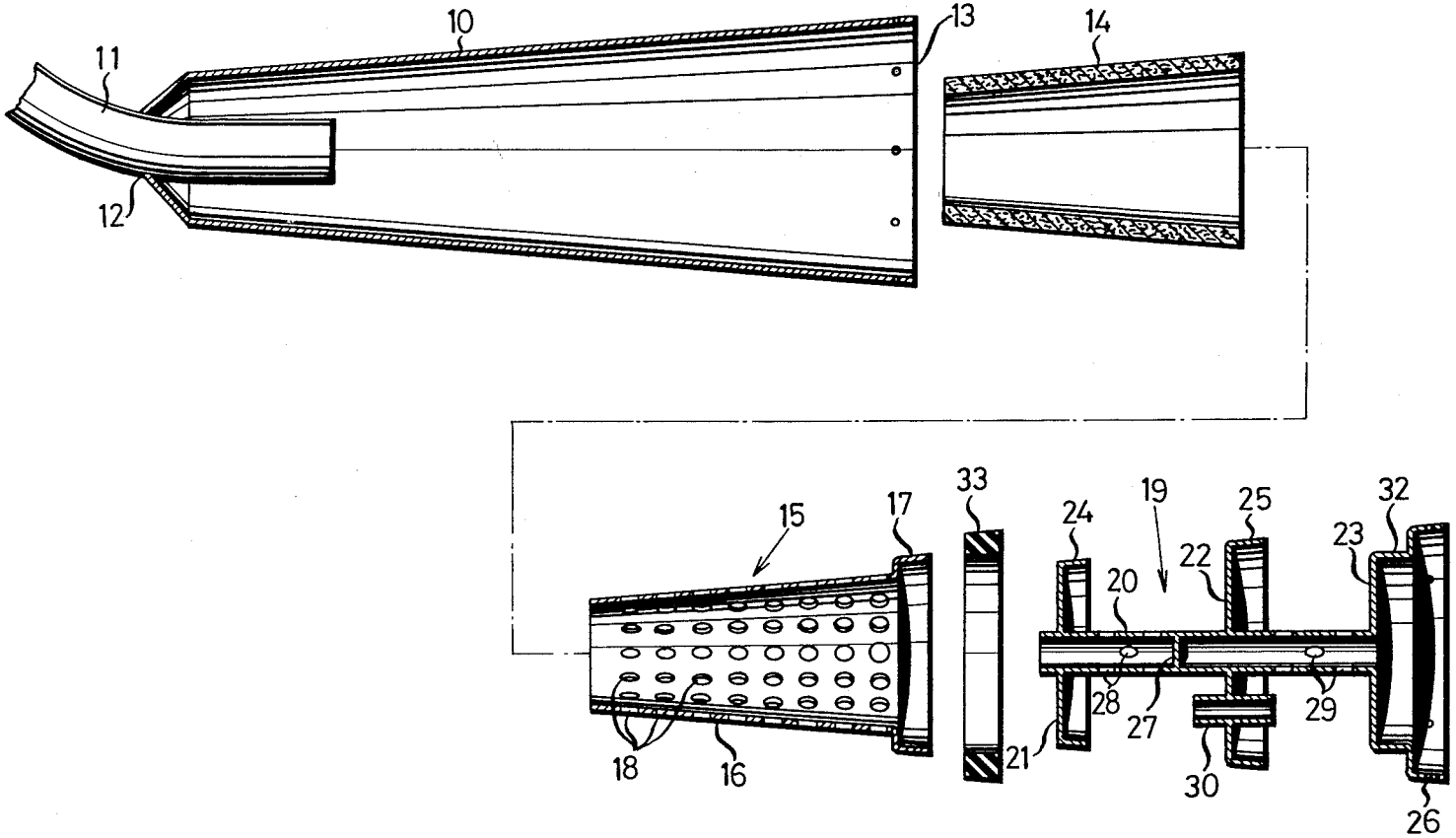
FIG. 2 is an exploded sectional view of the muffler according to the invention, enabling the process for fabricating the muffler to be readily and clearly understood.

The construction of the muffler according to the present invention and the elements thereof will be described by referring to an embodiment shown in FIGS. 2 and 3 in the order in which various elements of the muffler are assembled. As shown, a muffler body 10 is a substantially conical hollow member open at either end. The muffler body 10 may be roll formed as a unitary structure or composed of two halves produced by means of a press and joined as by welding. The muffler body 10 receives in its minor diameter opening (the opening on the left side as seen in FIGS. 2 and 3) and exhaust pipe 11 connected to an engine, not shown, and the exhaust pipe 11 is welded to the muffler body 10 at an edge 12 of the minor diameter opening into a unitary structure which is then plated on its surface, when necessary. In general, it is essential that plating be effected when the muffler is for a motorcycle engine because it can be seen from outside.

The muffler body 10 having the exhaust pipe 11 welded thereto has a sound-absorbing member 14 inserted into its interior through a major diameter opening 13 (the opening disposed on the right side as seen in FIGS. 2 and 3). The sound absorbing member 14 is shaped beforehand in a hollow conical form so that its outer configuration may conform to the inner configuration of a forward portion A of the muffler body 10 except for the foremost end portion (the left end portion in FIGS. 2 and 3). The hollow, conical sound-absorbing member 14 is also open at either end thereof, and may be produced by any known process, such as glass fiber forming, asbestos molding or wire cross molding.

After the sound-absorbing member 14 has been inserted in the muffler body 10, a keep member 15 is inserted into the interior of the muffler body 10 through the major diameter opening 13. The keep member 15 comprises a hollow frustoconical portion 16 of an outer configuration conforming to the inner configuration of the sound-absorbing member 14, and an annular flange 17 disposed at the rear end of the portion 16 or the right end as seen in FIGS. 2 and 3. The flange 17 is shaped such that when the keep member 15 is fitted in the muffler body 10 as shown in FIG. 3, the outer circumferential surface of the flange 17 conforms to the inner configuration of the muffler body 10. The keep member 15 is open at either end thereof, and its hollow, frustoconical portion 16 is formed with a multiplicity of small apertures 18. The keep member 15 may be formed of metal, with the apertures 18 formed by punching.

In the foregoing description, the sound-absorbing member 14 is first inserted in the muffler body 10, and then the keep member 15 is inserted in the sound-absorbing member 14 fitted in the muffler body 10. As shown in FIG. 3, the keep member 15 may be assembled with the sound absorbing member 14, and the assembly may be inserted in the muffler body 10 through the major diameter end 13 thereof.

A muffler core 19 is then inserted in the muffler body 10 through the major diameter end 13 thereof. The muffler core 19 includes a baffle tube 20 located in the center, and first to third baffle plates 21, 22 and 23 concentrically secured to the baffle tube 20 to form a unitary structure. The baffle plate 21 is located at the left end of the baffle tube 20, the third baffle plate 23 is located at the right end thereof, and the second baffle plate 22 is located substantially in the center thereof so that the three baffle plates 21, 22 and 23 are spaced apart from one another. The three baffle plates 21, 22 and 23 are integrally formed at their outer circumferential surface with annular flanges 24, 25 and 26 respectively, and have different diameters so that when the muffler core 19 is inserted in the muffler body 10 the baffle plates 21, 22 and 23 are snugly fitted in the interior of the muffler body 10. The baffle tube 20 is open at either end, and a partition wall 27 is arranged in the bore of the baffle tube 20 in a position leftwardly of the second baffle plate 22 in the center of the tube 20 as shown in FIGS. 2 and 3. As shown in FIG. 3, a suitable number of openings 28 are formed in the wall of a portion of the tube 20 leftwardly of the partition wall 27, and a suitable number of openings 29 are formed in the wall of a portion of the tube 20 rightwardly of the partition wall 27. A short tube 30 is secured to the second baffle plate and disposed substantially parallel to the baffle tube 20. The muffler core 19 may be formed of metal or synthetic resinous material.

The muffler core 19 of the aforesaid construction is inserted in the muffler body 10 and pressed from the right in FIG. 3. This brings the flange 24 of the first baffle plate 21 into contact at its outer circumferential surface with the inner surface of the flange 17 of the keep member 15, and presses the keep member 15 and sound-absorbing member 14 axially leftwardly of the muffler body 10. With the muffler body 10 tapering in going from its right end to its left end as shown in FIG. 3, the muffler core 19 can effectively move the keep member 15 toward the left end of the muffler body 10 and bring the sound-absorbing member 14 into intimate contact with the inner surface of the muffler body 10. Thus the sound-absorbing member 14 is held in position by the keep member 15 and clamped to the inner surface of the muffler body 10 at uniform surface pressure, and the flanges 25 and 26 of the second and third baffle plates 22 and 23 respectively are brought into pressing contact with the inner surface of the muffler body 10. The flange 24 of the first baffle plate 21 is forced against the flange 17 of the keep member 15 which in turn is forced against the inner surface of the muffler body 10.

After the sound-absorbing member 14 and keep member 15 are secured in place in a predetermined position in the muffler body 10, the flange 26 of the third baffle plate 23 of the muffler core 19 is secured to the wall of the muffler body 10 at the right end (rear end) thereof by rivets 31 as shown in FIG. 3. In place of using the rivets 31, the flange 26 may be secured to the wall of the muffler body 10 by welding, bolting, crimping or by means of snap rings. This completes the fabrication of a muffler. In order to avoid leakage of gas, an annular offset portion 32 may be advantageously formed in the third baffle plate 23 and fitted with a resilient seal ring 33 formed as of heat resisting rubber before the muffler core 19 is inserted in the muffler body 10. When the muffler is assembled, the seal ring 33 provides a gas seal between the wall of the muffler body 10 and the third baffle plate 23.

In FIG. 3, B, C and D designate a first chamber, a second chamber and a third chamber respectively defined by the wall of the muffler body 10 and the first to third baffle plates 21, 22 and 23. In the illustrated embodiment, the first chamber B defined by the keep member 15 and first baffle plate 21 is maintained in communication through the suitable number of openings 28 formed in the baffle tube 20 with the second chamber C which is maintained in communication through the short tube 30 secured to the second baffle plate 22 with the third chamber D which is in communication with the atmosphere through the suitable number of openings 29 formed in the baffle tube 20.

When the muffler of the aforesaid construction is connected to the engine and the engine is operated, exhaust emissions from the engine are introduced through the exhaust pipe 11 into the first chamber B where the exhaust gases are expanded. As the exhaust gases are expanded, the noises produced by the exhaust emissions are greatly reduced, and the exhaust gases are led through the openings 18 of the keep member 15 into the sound-absorbing member 14 so that the energy of noise is absorbed by the sound-absorbing member 14. The exhaust gases in the first chamber B pass through the baffle tube 20 of a small cross-sectional area and the openings 28 into the second chamber C of a large area where the exhaust gases are expanded again. The expanded exhaust gases pass through the short tube 30 of a small diameter into the third chamber D where the gases are expanded again. The expanded gases pass through the openings 29 and baffle tube 20 to be vented to the atmosphere. While the exhaust gases are expanded and contracted in passing through the second chamber C and third chamber D, the energy of noise is greatly reduced. Vibrations which might otherwise occur in the portion of the muffler body 10 cooperating with the keep member 15 to define the first chamber B due to pulsations of the exhaust gases or the vibrations which might otherwise be caused by the expansion and contraction of this portion of the muffler body 10 are inhibited by the sound-absorbing member 14.

The constructional form of the invention described hereinabove can obviate all the problems experienced by the prior art. The need to join the keep member 15 or the sound-absorbing member 14 to the muffler body 10 as by spot welding is eliminated, and consequently the buffing of the muffler body 10 that has hitherto been indispensable as after-treatment for mufflers for motorcycle engines following spot welding can be eliminated, thereby facilitating the fabrication of the muffler. The sound-absorbing member can be readily attached to the muffler body in cases where the muffler body is formed by roll forming. Plating of the muffler body for a motorcycle engine to render corrosion resistant can be effected on the muffler body before other elements of the muffler are assembled therewith or after the muffler body with no other muffler elements is connected to the exhaust pipe instead of after other elements of the muffler are assembled therewith as in the prior art. This enables the muffler fabricating process to be rationalized.

A preferred embodiment of the invention has been shown and described hereinabove. It is to be understood that the invention is not limited to the specific form and construction of the muffler shown and described and that many changes and modifications may be made therein. For example, the illustrated embodiment has three chambers defined in the muffler body. The number of the chambers if not limited to three and may be two or more than three. When this is the case, a suitable number of the baffle plates secured to the wall of the baffle tube has only to be selected depending on the number of chambers desired. When it is desired to provide two chambers, for example, two baffle plates are used, and when the number of chambers desired is four, then four baffle plates are used. A portion E of the muffler body 10 on the right side as seen in FIG. 3 may be less in the degree of tapering than the portion A of the muffler body 10 in which the sound-absorbing member 14 and keep member 15 are located or may be substantially cylindrical, without inconveniencing the insertion of the sound-absorbing member 14 and keep member 15 through the major diameter end 13 into the muffler body 10, thereby enabling the objects of the invention to be achieved. However, when the right side portion E of the muffler body 10 in which the muffler core is fitted is tapering as shown in FIG. 3, the flanges at the outer circumferential surfaces of the baffle plates are advantageously brought into intimate contact with the inner surface of the muffler body without any difficulty. The keep member is not limited to a perforated plate and may be of any shape as desired, such as a louvered plate or a mesh screen of metal or synthetic resinous material, so long as the transfer of exhaust gases to the sound-absorbing member is not blocked. The muffler body is not limited to a frustoconical shape and may be of any other tapering shape, such as a pyramidic shape. In this case, other elements (sound-absorbing member, keep member, etc.) should be shaped accordingly.

What is claimed is:

1. A muffler for an engine, particularly a motorcycle engine comprising:

(a) a hollow muffler body tapering at least in one portion thereof;

(b) a tapering hollow sound-absorbing member inserted in said muffler body through a major diameter end thereof and fitted in said tapering portion thereof;

(c) a keep body inserted in said muffler body through said major diameter end thereof and fitted in said sound-absorbing member to secure the sound-absorbing member in place, said keep member being of a construction allowing exhaust gases to permeate therethrough to the sound-absorbing member; and (d) a muffler core inserted in said muffler body through said major diameter end thereof after said sound-absorbing member and said keep member have been inserted therein, said muffler core comprising at least two baffle plates conforming to the inner surface of said muffler body and constructed such that said sound-absorbing member can be forced against the inner surface of the muffler body if the muffler core is pressed axially of the muffler body when the former is inserted in the latter, said at least two baffle plates defining at least two chambers within said muffler body maintained in fluid communication with one another.

2. A muffler as claimed in claim 1, wherein said muffler core further comprises a buffle tube extending axially of said muffler body for supporting said at least two baffle plates firmly secured thereto.

3. A muffler as claimed in claim 2, wherein said buffle tube is formed with a plurality of openings in the wall for maintaining said at least two chambers in communication with one another through said openings.

4. A muffler as claimed in any one of claims 1–3, wherein said baffle plates are at least three in number, at least one baffle plate having a short tube secured thereto except those baffle plates which are located at opposite ends of the muffler core to maintain said chambers defined by said baffle plates in communication with one another through said short tube.

5. A muffler as claimed in any one of claims 1–3, wherein said keep member is formed with a flange at one end thereof facing said muffler core maintained at its outer surface in pressing engagement with the inner surface of said muffler body, and wherein said baffle plates are each formed with a flange at the outer circumferential surface, the flange of the baffle plate nearest to said keep member being maintained in pressing engagement with the inner surface of the flange of said keep body while the flanges of the rest of the baffle plates are maintained in pressing engagement with the inner surface of said muffler body.

6. A muffler as claimed in any one of claims 1–3, wherein the sound-absorbing member is first inserted in the muffler body and then the keep member is inserted in the muffler body.

7. A muffler body as claimed in any one of claims 1–3, wherein the sound-absorbing member and the keep member are assembled beforehand into a unitary structure before being inserted into the muffler body.

8. A muffler as claimed in any one of claims 1–3, wherein the portion of the muffler body having the muffler core fitted therein tapers to a lesser degree than the portion of the muffler body having the sound-absorbing member fitted therein.

9. A muffler as claimed in any one of claims 1–3, wherein the portion of the muffler body having the muffler core fitted therein is not tapering.

10. A muffler as claimed in any one of claims 1–3, wherein the tapering portion of the muffler body is frustoconical in shape.

11. A muffler as claimed in any one of claims 1–3, wherein the muffler body is frustoconical in shape in its entirety.

12. A muffler as claimed in any one of claims 1–3, wherein said keep member comprises a perforated plate formed with a multiplicity of small openings.

13. A muffler as claimed in any one of claims 1–3, wherein said keep member comprises a louvered plate.

14. A muffler as claimed in any one of claims 1–3, wherein said keep plate comprises a mesh screen.

* * * * *